United States Patent [19]

Lamb

[11] 4,148,506

[45] Apr. 10, 1979

[54] PORTABLE DRAWING BOARD

[75] Inventor: Terrence R. Lamb, Washington, D.C.

[73] Assignee: Art Products, Inc., Chevy Chase, Md.

[21] Appl. No.: 843,230

[22] Filed: Oct. 18, 1977

[51] Int. Cl.[2] ..... B42D 3/00; B25B 1/00

[52] U.S. Cl. ..... 281/45; 269/254 D

[58] Field of Search ..... 281/1, 42, 43, 44, 45; 269/254 R, 254 D

[56] References Cited

U.S. PATENT DOCUMENTS

| | | | |
|---|---|---|---|
| 1,313,732 | 8/1919 | Raffo | 269/254 D |
| 1,394,538 | 10/1921 | Copeland | 269/254 D |
| 1,492,932 | 5/1924 | Orrell | 281/43 |
| 1,562,208 | 11/1925 | Drinkwater et al. | 269/254 D |
| 2,488,007 | 11/1949 | Dovitch | 281/45 |
| 2,489,165 | 11/1949 | Smith | 269/254 D |
| 2,658,302 | 11/1953 | Parker | 281/41 |
| 3,330,580 | 7/1967 | Vanek | 281/45 |

*Primary Examiner*—Harrison L. Hinson

*Attorney, Agent, or Firm*—Fleit & Jacobson

[57] ABSTRACT

A novel drawing board particularly adapted for use in making drawings or sketches from charcoals, pastels or similar materials is disclosed. The drawing board comprises a base member or board and a series of plates which are adapted to be positioned around the outer edge or periphery of the board. The individual plates, which are preferably formed of a transparent plastic, are removably secured to the board and, when secured to the board, form a margin or border for the sheets being held. The plates are secured to the board by bolt or other suitable means positioned through openings and/or slots formed in the base member and plates. In the use of the drawing board, the plates are loosened and are moved perpendicular relative to the edge of the board. One or more sheets of paper are then slipped between the plates and the board with the plates then being adjusted and tightened to secure the paper. The device is easily portable, inexpensively manufactured, and readily and uniquely designed for use in making sketches, drawings or paintings.

7 Claims, 6 Drawing Figures

PORTABLE DRAWING BOARD

BACKGROUND OF THE INVENTION

1. Field of the Invention

The present invention relates to a device for securing sheets of paper to a drawing board and, more particularly, to a unique drawing board for use in making paintings from charcoal, pastels, or like materials.

2. THE PRIOR ART

As known in the art, numerous drafting implements have been proposed for use in making drawings, sketches, etc. Specific examples of such devices are disclosed in U.S. Pat. Nos. 244,205; 864,254; 950,173; 1,759,989; 2,439,826 and 2,573,913. While many such prior art devices are known and have achieved, to some extent, commercial acceptance, there remains a long-felt need for a relatively inexpensive and simple drawing board for use in making drawings or sketches from pastels, charcoal, or the similar materials. In making this type of drawing or painting, artists conventionally simply tape a sheet of paper to a board or table. This simple expediency suffers, however, from the disadvantages that the tape often tears or damages the paper upon removal of the drawing from the board. Also, the pastel, charcoal, or chalk, etc. destroys any edge or border attempted to be left by the artist, the latter further causing significant difficulties in connection with the framing of the piece of art.

SUMMARY OF THE INVENTION

In summary, the present invention is directed to the portable drawing board having particular utility for use in making drawings or sketches from pastels or the like materials. The novel drawing board of the invention includes a base member or board and a series of plates, which are positioned around the periphery of the board. In its broadest aspects, the invention thus comprises a base member, forming a surface upon which the sheets of paper may be positioned, and a series of plates positioned on each side and along the periphery of the board. The individual plates are removably secured to the board, and are held stationary on the board by suitable means, wuch as bolt means positioned through openings in the base member and plates.

In operation of the drawing board of the invention, the plates are loosened and are moved perpendicular relative to the edge of the board. One or more sheets of paper are then slipped between the plates and the drawing board, with the plates being adjusted and tightened to secure the paper firmly to the board. The plates are designed such that they may be moved perpendicular relative to the side edges of the board and, when secured thereto, serve to form a margin or border for the painting itself. Specific advantages of the unique drawing board of the invention includes the fact that the sheets of paper or other drawing materials are securedly fixed to the board and yet may be easily released for the insertion of new paper and/or the removal of the top sheet upon which the drawing has been made. The device of the invention is also easily portable and readily designed for use in making sketches, drawings or paintings. As noted above, the series of plates are positioned at right angles relative to each other and along each edge of the board to form, when secured to the board, a mechanically adjustable margin or border for the sheets being held. This is particularly advantageous inasmuch as prior to the present invention no such device was available.

It is accordingly, a principal object of the present invention to provide a novel drawing board for use in making sketches, drawings and the like.

Another object is to provide an easily portable device including improved means for holding the paper upon which the sketch or drawing is to be made.

Yet still another object of the invention is to provide a novel drawing board having plate means which securely clamp a sheet, or series of sheets, in position and which may be easily removed for insertion or removal of said sheets.

Still a further object is to provide a novel drawing board which includes a series of plate members positioned around the periphery of a base member or board which form, when secured to said base member, a mechanically adjustable border or margin on the paper upon which the drawing or painting is to be made.

BRIEF DESCRIPTION OF THE DRAWINGS

The manner in which the foregoing and other objects are achieved in accordance with the present invention will be better understood in view of the following detailed description of the preferred embodiments and accompanyings drawings wherein.

DESCRIPTION OF THE PREFERRED EMBODIMENT(S)

Figures 1, 2, 3A, 3B, 4A, 4B:
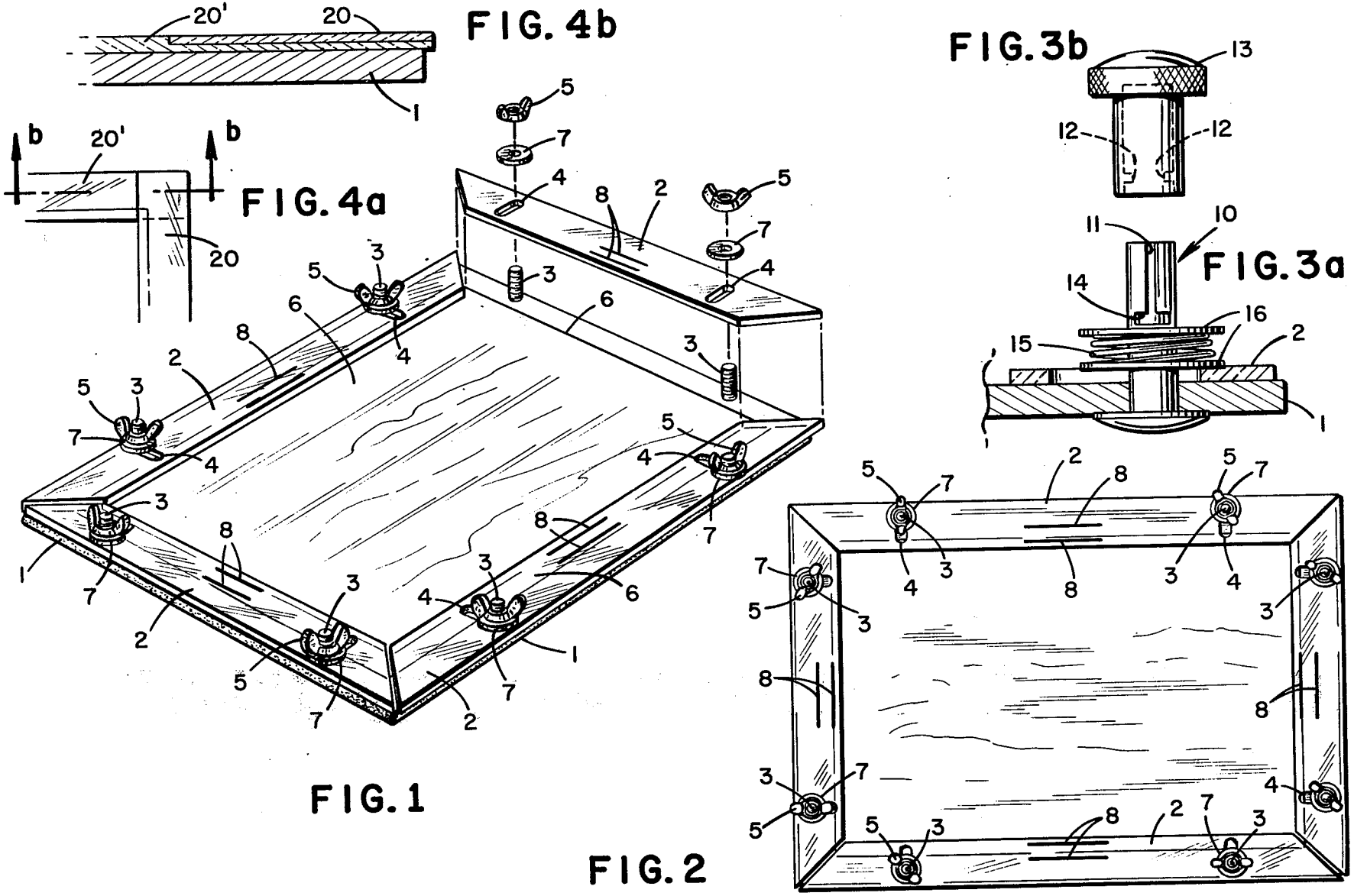
FIG. 1 is a perspective view, shown in elevation, of the novel drawing board provided in accordance with the present invention.
FIG. 2 is a plan view illustrating the plate members employed in combination with the drawing board of the invention.
FIGS. 3*a* and 3*b* are enlarged partial sectional views, shown in elevation, of locking means for removable securing the plate manners employed in the accordance with the present invention.
FIG. 4*a* is a partial plan view illustrating another embodiment of the plate members employed in combination with the drawing board.
FIG. 4*b* is an enlarged sectional view, taken along lines b–b, further illustrating the embodiment of FIG. 4*a*.

As noted above, the present invention relates to a novel drawing board which has particular utility for use in making drawings or sketches from pastels or like artist materials. The drawing board of the invention includes a base member and a series of substantially rectangular plates which are positioned along each edge of the board and which serve, when secured to the board, to form a margin or border for the sheet upon which the drawing is to be made.

With reference now to the drawings and first to FIG. 1, there is shown the unique drawing board of the invention which comprises a base member or board 1, and a series of plates 2 which are adapted to be positioned around the outer edge or periphery of the board. The drawing board itself may be formed of many varying materials, such as wood, masonite, or the like, but is preferably formed of a light-weight metal or alloy, such as aluminum. The individual plate members 2 are preferably formed of a plastic material, such as high-impact polyethylene, polystyrene, etc. The plates may, of course, also be formed of the same material as the base member 1. As to be discussed in more detail hereinafter, however, the plates 2 are preferably of a transparent plastic.

As shown in FIG. 1, the individual plate members 2 are removably secured to the base member 1 by way of suitable bolt means 3 which may be formed integral with the base member itself, or merely slipped through openings or apertures formed in the board. In this regard, the plate members are secured to the board by simply passing the bolt means through slots 4 formed in the plate members as shown in FIG. 1. These slots are, of course, in alignment with the bolt means 3. The plates are then secured to the board by merely tightening a suitable internally threaded nut, which is illustrated as wing nuts 5 in FIG. 1. In the practice of the invention, one or more sheets of paper, indicated at 6, are placed on the board with the plate members 2 then being adjusted and tightened to secure the sheets of paper firmly to the board. As shown by FIGS. 1 and 2, the plates 2 are designed such that they may be moved perpendicular relative to the side edges of the board and, when secured thereto, form a margin or border for the sheets of paper 6. This is particularly significant inasmuch as prior to the present invention, no suitable means were available to artist that would perform this function. The elongated slots 4, as shown in FIG. 1, extend perpendicular relative to the side edges of the board which permits the plate members 2 to be adjusted horizontally and perpendicularly relative to said side edges of the base member so that the sheets of paper 6 may be easily inserted and/or removed from the drawing board.

When the plate members are positioned and secured to the board, they form a rectangular frame, as shown in FIG. 2. In this regard, prior to the present invention, when using pastels, charcoal or the like, the margins or borders of the drawing would often be ruined by the dust or powder from the pastel or charcoal. This difficulty has been removed by the present invention inasmuch as the individual plate members, when formed in a manner shown in FIG. 2, serve as an effected seal against any powder or fines deposited from the materials used by the artist. In a further particularly advantageous embodiment of the invention, the individual plate members 2 preferrably include score lines 8 or other suitable indicia lines, which may be calibrated such that they give the artist a measurement as to the width of the margin. That is, they show the artist that the border is 1 inch, 2 inches, etc.

As should be readily appreciated by those skilled in the art, the drawing board of the invention is easily portable and readily designed for use in making sketches, drawings, or paintings. It is inexpensive to manufacture. While preferred embodiments have been shown for illustrative purposes, and it should also be understood by those skilled in this art that varying designs may be employed without departing from the claimed invention. For example, while the means employed to secure the plate members to the drawing board 1 have been shown as comprising the bolt (3)-wing-nut (5) arrangement of FIG. 1, other suitable structural arrangements may be employed. Also, the bolt means 3 may be formed integral with the plate members 2 with there being provided corresponding slots in the board member 1. In other words, the sliding adjustment of the plate members can be made by way of slots formed in the drawing board. As shown in FIG. 1, a washer 7 is preferably employed in combination with the bolt 3 and wing-nut 5 arrangement.

In FIGS. 3*a* and 3*b*, there is shown a further arrangement of apparatus that may be employed to secure the plates to the bound. In this embodiment, in lieu of the bolt-wing nut structure, there is provided an elongated cylindrical rod 10 that extends from the board and which may be formed integral therewith or simply inserted through openings in the board. As shown in FIG. 3*a*, vertical slots or grooves 11 are formed on each side of the cylindrical rod 10. These slots are adapted to receive mating locking or guide pins 12 formed on the internal surface of the locking mechanism or knob 13. In operation, the knob 13 is simply slipped onto the rod 10 such that the guide pins 12 mate, and ride in, the corresponding groove 11. The knob is pushed down and then rotated either right or left so that the pins are caused to rotate into horizontal slots 14. When the knob is in this closed position, a spring 15, held in place by way of washers 16, exerts a sufficient pressure on the plates 2 to hold the plates securely to the board.

In the embodiment of FIGS. 1 and 2, each end of the individual plate members 2 are formed by mating 45° angles. The plate members, however, may be formed such that the ends of the individual plates overlap, this embodiment being illustrated in FIGS. 4*a* and 4*b*. In this embodiment, the ends or corners of the plates 2 would be square and would be provided with mating grooves or recesses 21 so that when the plate 20, as best shown in FIG. 4*b*, is placed over the groove 21 provided in plate 20' the top surface of the mating or overlapping plates would be flush. In accordance with the invention, the plate members forming the margin for the sheets of paper may also comprise an integral one-piece frame member of the same general shape and design as the individual plates.

What is claimed is:

1. A drawing board comprising, in combination, a substantially rectangular board member; means for clamping one or more sheets of paper to said board member; said means comprising a series of plate members, each plate member extending longitudinally along a side edge of said board and forming, when secured to the said board member, a mechanically adjustable margin for said sheets of paper; means projecting from said board and said plate members for removably securing said plates to said board member, said plate members having openings provided therein; said openings provided in said plate members comprising elongated slots extending perpendicular to the edges of said board whereby said plate members may be moved perpendicular relative to the side edge of said board for adjusting the margin formed by said plates and, when in an open position, for removing one or more of said sheets of paper.

2. The drawing board in accordance with claim 1 wherein said board member is formed of a light-weight metal.

3. The drawing board in accordance with claim 2 wherein said plate members are formed of a light-weight transparent plastic material.

4. The drawing board in accordance with claim 3 wherein said transparent plate members further include indicia means for indicating the width of the margin formed by said plate member.

5. In a drawing board comprising a board member and clamping means for removably securing one or more sheets of paper to said board member, the improvement comprising, in combination, a board member; a series of substantially rectangular transparent plate members adapted to be placed along each edge of said board for securing one or more sheets of paper to said board member and means for clamping said plate members to said board, said plate members, when clamped to said board member, forming a margin for said sheets of paper.

6. The drawing board in accordance with claim 1 wherein said means projecting from said board and said plate members for removably securing said plates to said board comprises an externally threaded bolt.

7. The drawing board in accordance with claim 1 wherein said means projecting from said board and said plate members for removably securing said plates to said board comprises a cylindrical rod having opposing vertical slots formed on the outer surface thereof and horizontal slot in communication with, and formed at the lower end of, said vertical slots; locking means adapted to fit over said cylindrical rod, said locking means comprising a sleeve having an inner channel that mates with and is adapted to slip over said cylindrical rod, said inner channel having opposing guide pins formed on the inner surface thereof and adapted to fit in said vertical slots such that when said locking means is pushed down and rotated, said pins are caused to rotate into said horizontal slots.

* * * * *